US009799256B2

(12) United States Patent
Yoshiyama et al.

(10) Patent No.: US 9,799,256 B2
(45) Date of Patent: Oct. 24, 2017

(54) IMAGE PROCESSING DEVICE, IMAGE PROCESSING METHOD, AND IMAGE DISPLAY DEVICE

(71) Applicant: SAMSUNG DISPLAY CO, LTD., Yongin-si, Gyeonggi-Do (KR)

(72) Inventors: Masahiko Yoshiyama, Yokohama (JP); Hiroshi Ohishi, Yokohama (JP); Takashi Yasuoka, Yokohama (JP)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 56 days.

(21) Appl. No.: 14/919,316

(22) Filed: Oct. 21, 2015

(65) Prior Publication Data

US 2016/0117972 A1 Apr. 28, 2016

(30) Foreign Application Priority Data

Oct. 22, 2014 (JP) ..... 2014-215725

(51) Int. Cl.
*G09G 3/20* (2006.01)
*G09G 3/3208* (2016.01)

(52) U.S. Cl.
CPC ..... *G09G 3/2007* (2013.01); *G09G 3/3208* (2013.01); *G09G 2320/0238* (2013.01); *G09G 2320/0271* (2013.01); *G09G 2320/0626* (2013.01); *G09G 2360/144* (2013.01); *G09G 2360/145* (2013.01)

(58) Field of Classification Search
CPC ..... G09G 3/3208; G09G 2320/0233; G09G 2320/0238; G09G 2320/0242; G09G 2320/0271; G09G 2360/144
See application file for complete search history.

(56) References Cited

U.S. PATENT DOCUMENTS 7,595,811 B2 * 9/2009 Matsuda ..... G09G 5/00 345/207
8,548,528 B2 10/2013 Kim et al.
8,847,997 B2 * 9/2014 Seo ..... G09G 3/3225 345/690
2013/0314433 A1 * 11/2013 Ko ..... G09G 3/20 345/592

(Continued)

FOREIGN PATENT DOCUMENTS

EP 1510994 3/2005
JP 2008-242134 10/2008

(Continued)

*Primary Examiner* — Antonio A Caschera
(74) *Attorney, Agent, or Firm* — F. Chau & Associates, LLC

(57) ABSTRACT

An image processing device includes a light detection unit and an image conversion unit. The light detection unit is configured to detect a first grayscale value of a background image. The background image is an image seen by a user through an at least partially transparent display panel. The image conversion unit is configured to generate a correction image having a second grayscale value obtained by subtracting a third grayscale value pertaining to the first grayscale value from a fourth grayscale value of an input image inputted to the at least partially transparent display panel. The input image is an image intended to be displayed on the at least partially transparent display panel.

15 Claims, 6 Drawing Sheets

(56) References Cited

U.S. PATENT DOCUMENTS

2014/0253605 A1* 9/2014 Border ..... G02B 27/0172
345/690

FOREIGN PATENT DOCUMENTS

| | | |
|---|---|---|
| JP | 2012-247548 | 12/2012 |
| JP | 2013-041098 | 2/2013 |
| JP | 2013-156635 | 8/2013 |

* cited by examiner

IMAGE PROCESSING DEVICE, IMAGE PROCESSING METHOD, AND IMAGE DISPLAY DEVICE

CROSS-REFERENCE TO RELATED APPLICATIONS

This U.S. non-provisional patent application claims priority under 35 U.S.C. §119 to Japanese Patent Application No. JP2014-215725, filed on Oct. 22, 2014, the disclosure of which is incorporated by reference herein in its entirety.

TECHNICAL FIELD

The present inventive concept relates to an image display device, and more particularly to an image processing device, an image processing method, and an image display device.

DISCUSSION OF THE RELATED ART

A transparent display device may allow a user to see through an image behind the display device, which, hereinafter, is referred to as a background image. The background image may prevent a user from being able to clearly see an image which is originally displayed.

SUMMARY

According to an exemplary embodiment of the present inventive concept, an image processing device is provided. The image processing device includes a light detection unit and an image conversion unit. The light detection unit is configured to detect a first grayscale value of a background image. The background image is an image seen by a user through an at least one partially transparent display panel. The image conversion unit is configured to generate a correction image having a second grayscale value obtained by subtracting a third grayscale value pertaining to the first grayscale value from a fourth grayscale value of an input image inputted to the at least one partially transparent display panel. The input image is an image intended to be displayed on the at least one partially transparent display panel.

The at least one partially transparent display panel may include an organic light emitting device.

The image conversion unit may adjust the second grayscale value to a minimum value when the fourth grayscale value is smaller than the first grayscale value.

The image conversion unit may increase the third grayscale value when the fourth grayscale value increases from a minimum value to the first grayscale value.

The image conversion unit may decrease the third grayscale value when the fourth grayscale value increases from the first grayscale value toward a maximum value.

The image conversion unit may increase the third grayscale value when the fourth grayscale value increases from a minimum value to a fifth grayscale value higher than the first grayscale value.

The image conversion unit may decrease the third grayscale value when the fourth grayscale value increases from the fifth grayscale value toward a maximum value.

According to an exemplary embodiment of the present inventive concept, an image processing method is provided. The method includes detecting a first grayscale value of a background image and generating a correction image having a second grayscale value obtained by subtracting a third grayscale value pertaining to the first grayscale value from a fourth grayscale value of an input image inputted to the at least partially transparent display panel. The background image is an image seen by a user through the at least partially transparent display panel. The input image is an image intended to be displayed on the at least partially transparent display panel.

According to an exemplary embodiment of the present inventive concept, a display device is provided. The display device includes an at least partially transparent display panel and a light detection unit. The at least partially transparent display panel displays an input image. The light detection unit is configured to detect a first grayscale value of a background image. The background image is an image behind and through the at least partially transparent display panel. The image conversion unit is configured to generate a correction image having a second grayscale value obtained by subtracting a third grayscale value pertaining to the first grayscale value from a fourth grayscale value of the input image inputted to the at least partially transparent display panel, and to output the generated correction image to the at least partially transparent display panel. The input image is an image intended to be displayed on the at least partially transparent display panel.

The at least partially transparent display panel may include an organic light emitting device.

According to an exemplary embodiment of the present inventive concept, a display device is provided. The display device includes an at least partially transparent display panel and a display control unit. The at least partially transparent display panel displays an intended image. The display control unit generates a correction image to the at least partially transparent display panel. The display control unit includes an optical measurement device, a light detection unit, and an image conversion unit. The optical measurement device measures information corresponding to a background image. The background image is an image seen by a user through the at least partially transparent display panel. The light detection unit obtains a first grayscale value based on the information output from the optical measurement device. The image conversion unit is configured to generate the correction image having a second grayscale value obtained by subtracting a third grayscale value pertaining to the first grayscale value from a fourth grayscale value of the intended image. The second grayscale changes in a first slope with respect to the fourth grayscale value when the fourth grayscale value is less than a reference value. The second grayscale changes in a second slope with respect to the fourth grayscale value when the fourth grayscale value is greater than the reference value. The second slope is higher than the first slope.

The at least partially transparent display panel may include an organic light emitting device.

The first slope may be zero when the fourth grayscale value is less than the reference value.

The reference value may be equal to or greater than the first grayscale value.

A maximum value of the second grayscale value and a maximum value of the fourth grayscale value may be the same as each other.

BRIEF DESCRIPTION OF THE FIGURES

A more complete appreciation of the present invention and many of the attendant aspects thereof will be readily obtained as the same becomes better understood by reference to the following detailed description when considered in connection with the accompanying drawings, wherein.

DETAILED DESCRIPTION OF THE EMBODIMENTS

Hereinafter, exemplary embodiments of the present inventive concept will be described in more detail with reference to the accompanying drawings. The same reference numbers may indicate the same elements throughout the specification and drawings. In the attached figures, the thickness of layers and regions may be exaggerated for clarity.

A transparent display device might not be prepared with a backlight and may be implemented using a self emission type organic light emitting display device in which a pixel itself emits light. In this case, an organic light emitting display device may allow a user to see through the display device to a background image in a non-display state by using a transparent electrode.

In addition, since the transparent organic light emitting display device does not block the background image, the background image may overpower an image intended to be displayed (e.g., an intended image), and thus, if the intended image is dark (e.g., black, or not bright), the background image may be seen through the display device by a user.

Figure 1:
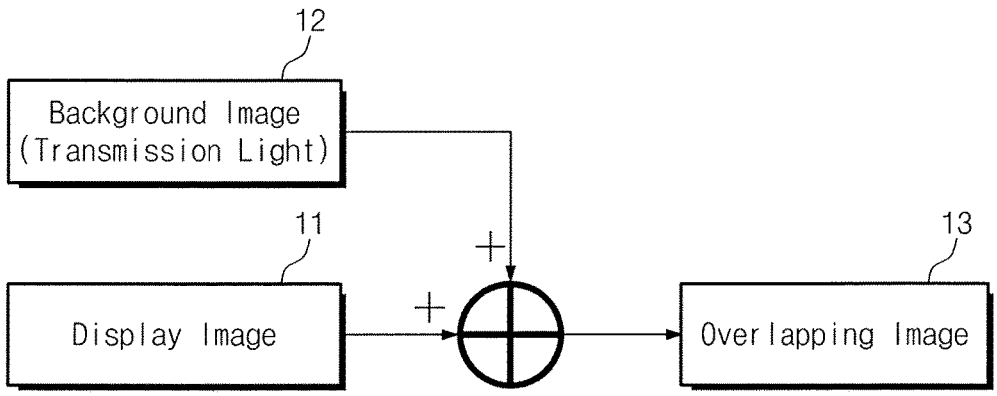
FIG. 1 is a view illustrating a process of an image display on a transparent display device according to an embodiment of the present inventive concept.

FIG. 1 is a view illustrating a process of an image display on a transparent display device according to an exemplary embodiment of the present inventive concept. Referring to FIG. 1. When a display image 11 (e.g., an intended image) is displayed on the transparent display device, an image 12 (e.g., a background image) that is incident through a rear portion of the transparent display device and penetrates the transparent display device may overpower the display image 11.

When the display image 11 includes no black or dark color portion (e.g., the display image 11 is bright), the background image 12 might not be seen through the transparent display device. When the display image 11 includes a black or dark color portion, the background image 12 may overpower the display image 11 and may be seen through the transparent display device, and thus, an image 13 in which the background image 12 overpowers the display image 11 may be seen through the transparent display device.

Accordingly, the background image 12 may prevent an intended image (e.g., the display image 12) from being clearly seen by a user.

Accordingly, the transparent display device according to an embodiment of the present inventive concept may suppress the influence of the background image 12 on the display image 11 without significantly increasing manufacturing cost.

Figure 2:
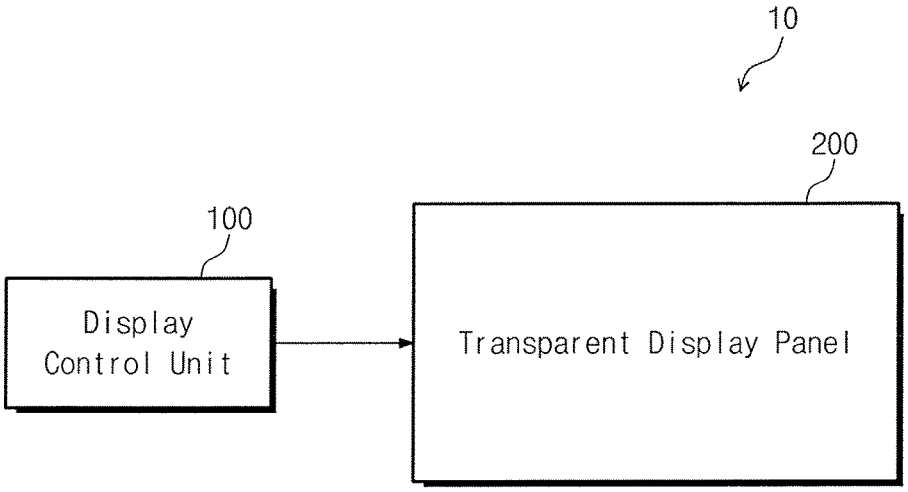
FIG. 2 is a block diagram of an image display device according to an embodiment of the present inventive concept.

FIG. 2 is a block diagram of an image display device 10 according to an embodiment of the present inventive concept.

Referring to FIG. 2, the image display device 10 includes a display control unit 100 and a transparent display panel 200.

The display control unit 100 may display an image through a transparent display panel 200. The display control unit 100 may receive an image signal from, e.g., an external device. For example, the image signals corresponding to predetermined shapes, characters, and photos are provided to the display control unit 100.

According to an embodiment of the present inventive concept, the display control unit 100 may be a control unit for displaying an image through the transparent display panel 200. The display control unit 100 may perform image conversion on a display image 11. For example, the display control unit 100 may adjust (e.g., lower) a grayscale value of a display image 11 based on information corresponding to a background image 12 (e.g., light that is incident through a rear side of the transparent display panel 200 and penetrates therethrough). After adjusting the grayscale value of the display image 11, the display control unit 100 may output an image signal corresponding to the adjusted display image 11 to the transparent display panel 200.

The transparent display panel 200 includes a light emitting device having a transparent material. For example, since light (e.g., the background image 12) output from the rear portion of the image display device 10 penetrates the transparent display panel 200, an image corresponding to an object at the rear may be seen by a user at the front of the transparent display panel 200. For example, the transparent display panel 200 may include a plurality of organic electroluminescent (EL) devices, which serves as light emitting devices, in a matrix form. In addition, the transparent display panel 200 may use a transparent electrode. The transparent display panel 200 may display an image on the basis of an image signal provided from the display control unit 100.

According to an embodiment of the present inventive concept, the transparent display panel 200 displays an image in response to the image signal whose grayscale value is adjusted (e.g., lowered) on the basis of a predetermined grayscale range. Hereinafter, the image signal whose grayscale value is adjusted may be referred to as a "correction image signal". The predetermined grayscale range may be a low grayscale range, e.g., a grayscale range lower than a threshold value.

As described above, the transparent display panel 200 displays an image on the basis of the correction image signal. Thus, the transparent display panel 200 may display an originally intended image (e.g., the display image 11) by using the correction image signal corresponding to a correction image 14. For example, the correction image 14 may be obtained by suppressing a portion corresponding to the background image 12 from the display image 11.

Figure 3:
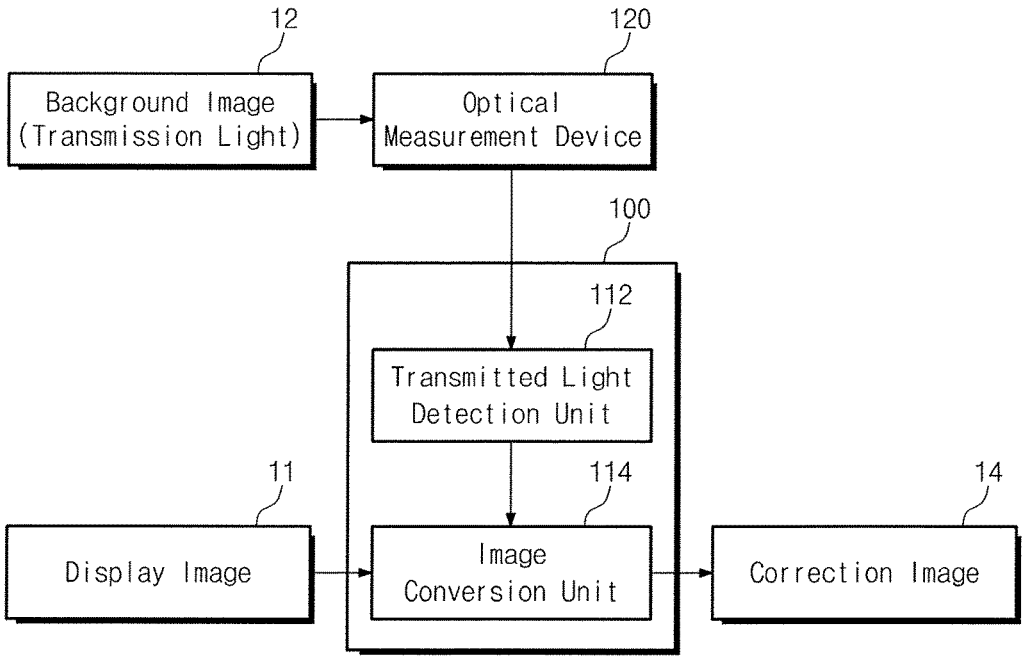
FIG. 3 is a view illustrating a configuration and an operation of a display control unit according to an embodiment of the present inventive concept.

FIG. 3 is a view illustrating a configuration and an operation of a display control unit 100 according to an embodiment of the present inventive concept.

Referring to FIG. 3, the display control unit 100 includes a transmitted light detection unit 112 and an image conversion unit 114.

The transmitted light detection unit 112 obtains information (e.g., brightness) corresponding to a background image 12 (e.g., light that is incident through a rear side of the transparent display panel 200 and passes therethrough) from an optical measurement device 120. The background image 12 may be an image seen by a user through the transparent display panel 200. For example, the background image 12 may be an image positioned behind the transparent display panel 200 and might not be an image intended to be displayed on the transparent display panel 200. The optical measurement device 120 may be provided around the transparent display panel 200.

For example, the transmitted light detection unit 112 obtains information corresponding to the grayscale value of the background image 12 and outputs the obtained information to the image conversion unit 114. Thus, the image conversion unit 114 may subtract the grayscale value of the background image 12 from a gray scale value of the display image 11.

The optical measurement device 120 may include a device (e.g., an illumination sensor, a photodiode, a camera, or the like) for obtaining the illumination (e.g., brightness) of the background image 12. As the optical measurement device 120 measures the illumination (e.g., the brightness) of the background image 12, the transmitted light detection unit 112 may receive grayscale information on the background image 12.

The image conversion unit 114 executes image conversion on the display image 11 by subtracting a grayscale value of the background image 12 from a grayscale value of the display image 11, and generates a correction image 14. The image conversion unit 114 outputs a correction image signal corresponding to the correction image 14 to the transparent display panel 200.

The display control unit 100 may generate the correction image signal to display an image through the transparent display panel 200 on the basis of the correction image signal that corresponds to the correction image 14 whose grayscale value is lowered based on the grayscale value of the background image 12. Accordingly, the transparent display panel 200 may display an originally intended image where the background image 12 is suppressed.

Figure 4:
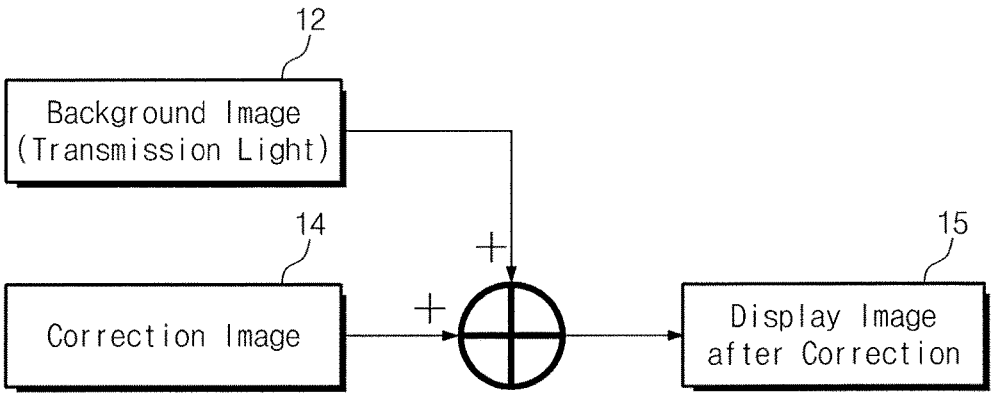
FIG. 4 is a view illustrating a process of an image display on a transparent display panel according to an embodiment of the present inventive concept.

FIG. 4 is a view illustrating a process of an image display on the transparent display panel 200 according to an embodiment of the present inventive concept.

Referring to FIG. 4, the correction image 14 is an image obtained by adjusting a grayscale value of a dark image to a value greater than (e.g., brighter than) a reference value. The transparent display panel 200 may display a corrected display image 15. Since the corrected display image 15 is an image obtained by combining the correction image 14 and the background image 12, the corrected display image 15 may be similar to an intended display image that originally would have been displayed on the transparent display panel 200.

Figure 5:
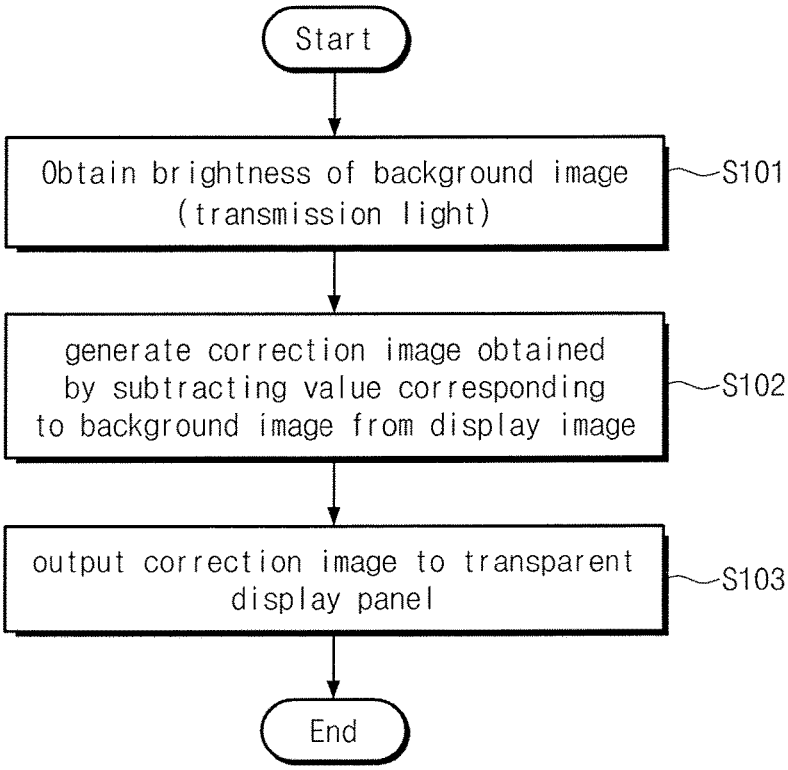
FIG. 5 is a flowchart illustrating an operation of an image display device according to an embodiment of the present inventive concept.

FIG. 5 is a flowchart illustrating an operation of an image display device 10 according to an embodiment of the present inventive concept. Referring to FIG. 5, image conversion processing, which subtracts a grayscale value of a background image 12 (e.g., light that is incident through a rear side of the transparent display panel 200 and passes therethrough) from a grayscale value of a display image 11, may be performed on the display image 11, and thus, an originally intended image may be displayed on the transparent display panel 200.

In operation S101, the image display device 10 obtains the brightness (e.g., illumination) of the background image 12 from the optical measurement device 120. The optical measurement device 120 may be provided in one or more locations around the transparent display panel 200. For example, the transmitted light detection unit 112 executes operation S101.

In operation S102, the image display device 10 generates the correction image 14 that is obtained by subtracting a grayscale value of the background image 12 from the grayscale value of the display image 11 that is to be displayed on the transparent display panel 200. For example, the image conversion unit 114 executes operation S102.

In operation S103, the image display device 10 (e.g., the image conversion unit 114) outputs a correction image signal corresponding to the correction image 14 generated in operation S102 to the transparent display panel 200.

Figure 6:
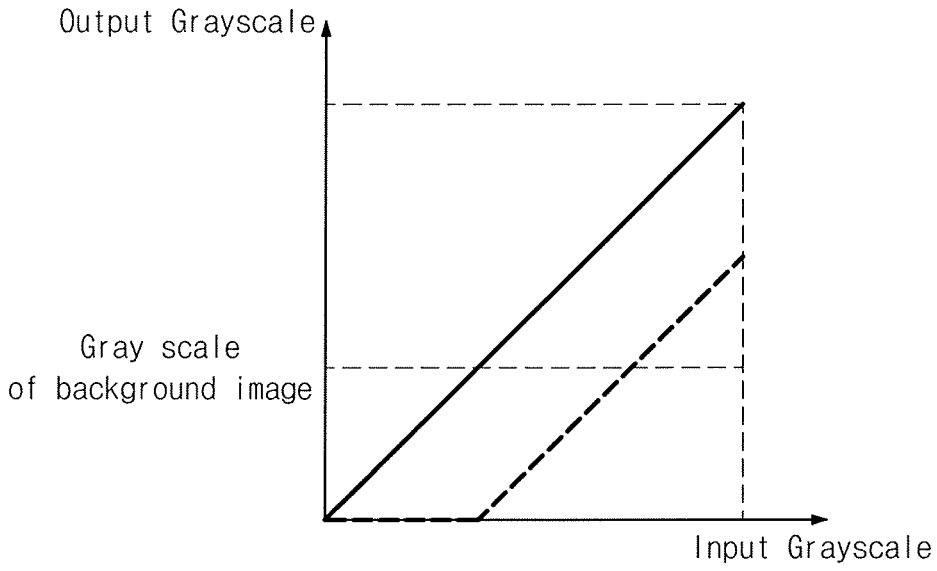
FIG. 6 is a graph illustrating image conversion processing performed by an image conversion unit according to an embodiment of the present inventive concept.

FIG. 6 is a graph illustrating image conversion processing performed by an image conversion unit 114 (e.g., in operation S102) according to an embodiment of the present inventive concept.

Referring to FIGS. 5 and 6, a solid line of FIG. 6 represents a relationship between an input grayscale value (e.g., a grayscale value of the display image 11 input to the image conversion unit 114) and an output grayscale value (e.g., a grayscale value of an image output from the image conversion unit 114) when no image conversion processing is performed. A broken line represents a relationship between an input grayscale (e.g., a grayscale value of the display image 11 input to the image conversion unit 114) and an output grayscale (e.g., a grayscale value corresponding to the correction image 14 output from the image conversion unit 114) when the image conversion processing is performed. The image conversion processing may include subtracting a grayscale value of the background image 12 from a grayscale value of the display image 11.

Referring to FIG. 6, the image conversion unit 114 may perform image conversion processing such that the same grayscale value corresponding to the background image 12 is subtracted from an input grayscale value (e.g., the grayscale value of the display image 11) to the image conversion unit 114 when the input grayscale value is smaller than a reference value (e.g., the grayscale value of the background image 12). In addition, the output grayscale value of the image conversion unit 114 may have a substantially constant value when the input grayscale value is smaller than the reference value. For example, the minimum and maximum values of the input grayscale values may be normalized to 0 and 100. Hereinafter, grayscale values in the specification and drawings may be normalized values unless otherwise explicitly stated therein.

For example, when a grayscale value of a background image 12 is obtained to be 30 based on, e.g., the brightness of the background image 12, the image conversion unit 114 outputs an output grayscale value of 0 until an input grayscale value reaches 30. In addition, when the input grayscale value exceeds 30, the image conversion unit 114 outputs an output grayscale value obtained by subtracting 30 (e.g., the grayscale value of the background image 12) from the input grayscale value.

The image conversion unit 114 may display an image on the transparent display panel 200 based on a correction image signal obtained by subtracting a grayscale value of the background image 12 from a grayscale value of the display image 11.

However, the conversion processing by the image conversion unit 114 of the present inventive concept is not limited to the descriptions with reference to FIG. 6.

Referring to FIG. 6, when a grayscale value of the background image 12 is subtracted from an input grayscale value corresponding to the display image 11 as shown in FIG. 6, the grayscale value of the background image 12 may be greater than the input grayscale value (e.g., a grayscale value of the display image 11). Thus, a resulting grayscale value obtained by subtracting the grayscale value of the background image 12 from the input grayscale value may be negative.

Thus, the output grayscale values may be displayed as 0 when a resulting value of subtracting the grayscale value of the background image 12 from the input grayscale value of the display image 11 is negative (e.g., when the grayscale value of the background image 12 is greater than the input grayscale value). In this case, in the corrected display image 15, dark portions each having a grayscale value lower than a grayscale value of the background image 12 may be displayed with substantially the same brightness, and a grayscale change in each dark portion might not be displayed. This is referred to as a "black defect".

To prevent the black defect, the image conversion unit 114 may change a grayscale value, which will be subtracted from the input grayscale value (e.g., a grayscale value of the display image 11), when the grayscale value of the background image 12 is greater than the input grayscale value, and thus, an output grayscale value may have a value other than zero. For example, a grayscale value which will be subtracted from an input grayscale is referred to as a "background grayscale value".

Figure 7:
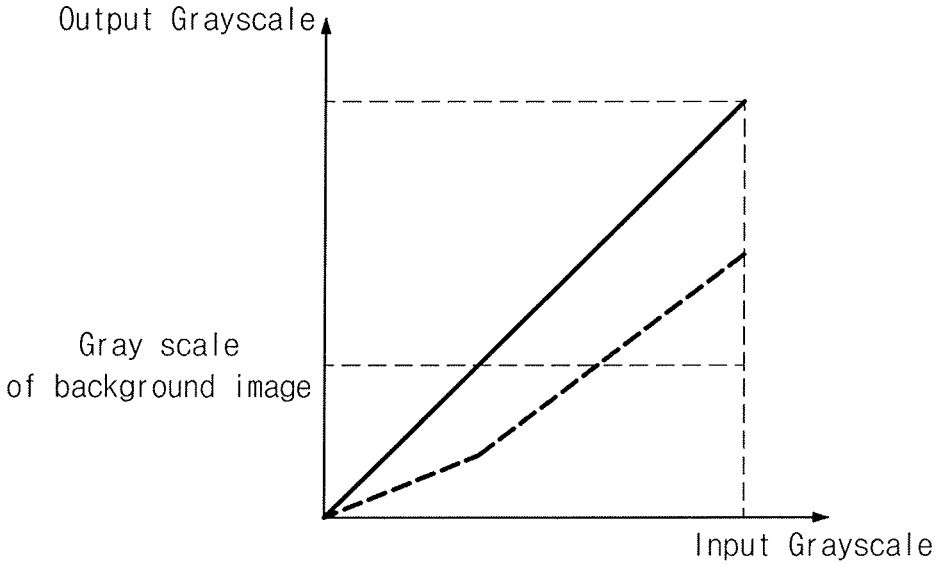
FIG. 7 is a graph illustrating image conversion processing performed by an image conversion unit according to an embodiment of the present inventive concept.

FIG. 7 is a graph illustrating image conversion processing performed by an image conversion unit 114 (e.g., in operation S102) according to an exemplary embodiment of the present inventive concept.

A solid line in the graph shown in FIG. 7 represents a relationship between an input grayscale value (e.g., a grayscale value of the display image 11 input to the image conversion unit 114) and an output grayscale value (e.g., a grayscale value of an image output from the image conversion unit 114) when no image conversion processing is performed. A broken line represents a relationship between an input grayscale value (e.g., a grayscale value of the display image 11 input to the image conversion unit 114) and an output grayscale value (e.g., a grayscale value corresponding to the correction image 14 output from the image conversion unit 114) when the image conversion processing is performed. The image conversion processing may include subtracting the background grayscale value from the input grayscale value.

Referring to FIG. 7, the image conversion unit 114 may output an output grayscale value more than 0 when the input grayscale value is lower than a reference value (e.g., a grayscale value of the background image 12).

For example, referring back to FIG. 6, the image conversion unit 114 outputs an output grayscale value of 0 until an input grayscale values reaches 30 (e.g., the grayscale value of the background image 12). Referring to FIG. 7, the image conversion unit 114 outputs an output grayscale value greater than 0 (e.g., instead of a grayscale value of 0) for the input grayscale values smaller than 30. In this case, until the input grayscale value becomes 30, the image conversion unit 114 may gradually increase the background grayscale value (e.g., a grayscale value which will be subtracted from the input grayscale value) from a minimum value. Thus, until the grayscale value of the input grayscale becomes 30, an output grayscale value of the correction image 140 may gradually be increased. For example, the minimum grayscale value may be 0, which might not be a normalized value, and the maximum grayscale value may be 255, which might not be a normalized value.

Thus, the black defect may be prevented according to an exemplary relationship between the input and output grayscale values described with reference to FIG. 7. According to an embodiment of the present inventive concept, when an input grayscale value (e.g., a grayscale value of the display image 11) increases from a minimum value to a grayscale value of the background image sensor 12, the image conversion unit 114 may gradually increase the background grayscale value. Thus, when the input grayscale value of the display image 11 is less than the grayscale value of the background image 12, an output grayscale value (e.g., a value of subtracting the gradually increased background grayscale value from the input grayscale value) corresponding to the correction image 15 may gradually be increased.

The image conversion unit 114 according to an exemplary embodiment of the present inventive concept may prevent the black defect that may occur at a dark portion of the corrected display image 15 by performing image conversion processing on the display image 11 such that the input grayscale value corresponding to the display image 11 and the output grayscale value corresponding to the correction image 15 have a relationship as shown in FIG. 7.

Figure 8:
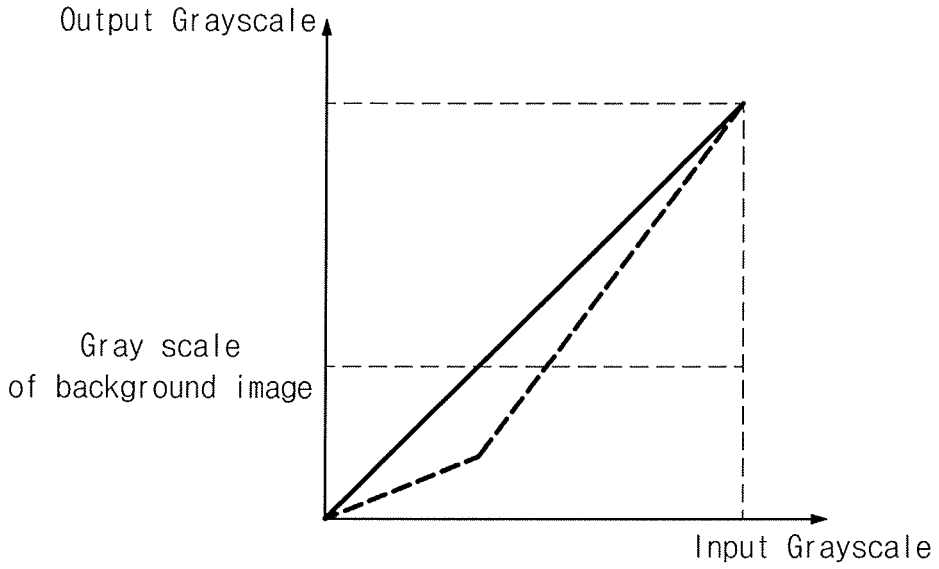
FIG. 8 is a graph illustrating image conversion processing performed by an image conversion unit according to an embodiment of the present inventive concept.

FIG. 8 is a graph illustrating image conversion processing performed by an image conversion unit 114 (e.g., in operation S102) according to an exemplary embodiment of the present inventive concept.

A solid line in the graph shown in FIG. 8 represents a relationship between an input grayscale value (e.g., a grayscale value of the display image 11 input to the image conversion unit 114) and an output grayscale value (e.g., a grayscale value of an image output from the image conversion unit 114) when no image conversion processing is performed. A broken line represents a relationship between an input grayscale value (e.g., a grayscale value of the display image 11 input to the image conversion unit 114) and an output grayscale value (e.g., a grayscale value corresponding to the correction image 14 output from the image conversion unit 114) when the image conversion processing is performed. The image conversion processing may include subtracting the background grayscale value from the input grayscale value.

Referring to FIG. 8, the image conversion unit 114 may output an output grayscale value more than 0 when the input grayscale value is lower than a reference value (e.g., the grayscale value of the background image 12).

For example, referring back to FIG. 6, the image conversion unit 114 outputs an output grayscale value of 0 until an input grayscale value reaches 30. Referring to FIG. 8, the image conversion unit 114 outputs an output grayscale value greater than 0 (e.g., instead of a grayscale value of 0) until the input grayscale value reaches 30. Thus, when the input grayscale value is less than the grayscale value (e.g., 30) of the background image 12, the image conversion unit 114 may gradually increase an output grayscale value (e.g., a value of subtracting the gradually increased background grayscale value from the input grayscale value) corresponding to the correction image 15.

Referring to FIG. 8, the image conversion unit 114 may perform image conversion processing such that the maximum value of an input grayscale and the maximum value of an output grayscale are the same when the input grayscale value reaches the maximum value. Hereinafter, a section where the input grayscale value is less than the grayscale value of the background image 12 is referred to as a first section, and a section where the input grayscale value is greater than the grayscale value of the background image 12 is referred to as a second section. In this case, the grayscale value of the correction image 14 may be increased more greatly in the second section than in the first section. For example, the grayscale value that will be subtracted from the input grayscale value may gradually be decreased in the second section.

Referring to FIG. 8, the image conversion unit 114 may perform image conversion processing on the display image 11 such that the input grayscale value corresponding to the display image 11 and the output grayscale value corresponding to the correction image 15 have a relationship as shown in FIG. 8. Thus, the black defect may be prevented in a dark portion of the corrected display image 15 according to an exemplary embodiment described with reference to FIG. 8.

Thus, when the corrected display image 15 obtained by a relationship between the input and output grayscale values graph is displayed on the transparent display panel 200, an image for a high grayscale section (e.g., the second section) may be seen clearly.

Referring to FIGS. 6 and 7, a range of the output grayscale value becomes narrow depending on a range of an input image grayscale after the image conversion processing is performed. Referring to FIG. 8, a range of the output grayscale value might not get narrower by gradually increasing the background grayscale value in the first section of the input grayscale and gradually decreasing the background grayscale value in the second section of the input grayscale.

Figure 9:
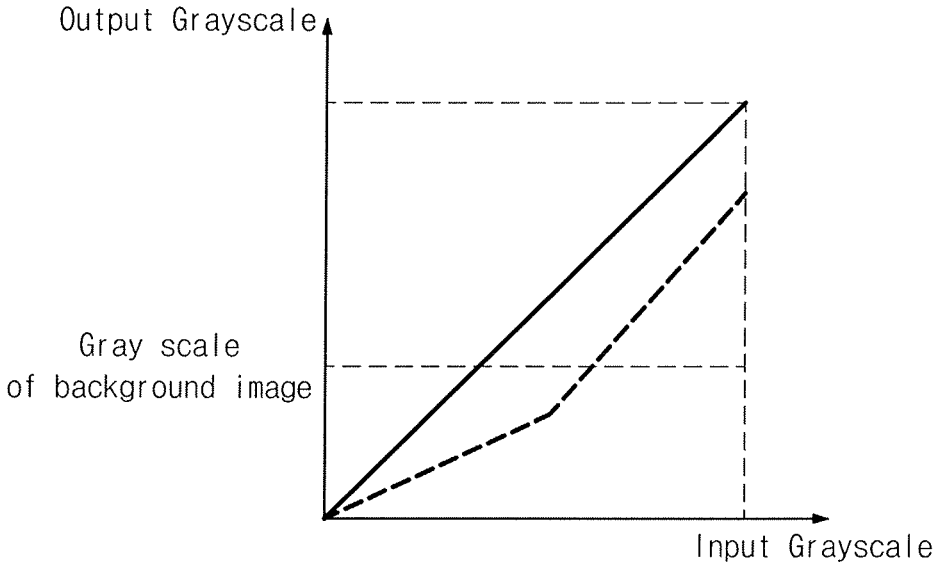
FIG. 9 is a graph illustrating image conversion processing performed by an image conversion unit according to an embodiment of the present inventive concept.

FIG. 9 is a graph illustrating image conversion processing performed by an image conversion unit 114 (e.g., in operation S102) according to an exemplary embodiment of the present inventive concept.

A solid line in the graph shown in FIG. 9 represents a relationship between an input grayscale value (e.g., a grayscale value of the display image 11 input to the image conversion unit 114) and an output grayscale value (e.g., a grayscale value of an image output from the image conversion unit 114) when no image conversion processing is performed. A broken line represents a relationship between an input grayscale value (e.g., a grayscale value of the display image 11 input to the image conversion unit 114) and an output grayscale value (e.g., a grayscale value corresponding to the correction image 14 output from the image conversion unit 114) when the image conversion processing is performed. The image conversion processing may include subtracting the background grayscale value from the input grayscale value.

Referring to FIG. 9, the image conversion unit 114 may output an output grayscale value more than 0 when the input grayscale value is lower than a reference value.

For example, referring back to FIG. 6, the image conversion unit 114 outputs an output grayscale value of 0 until an input grayscale value reaches 30. Referring to FIG. 9, the image conversion unit 114 outputs an output grayscale value greater than 0 until an input grayscale value reaches a reference value, e.g., 50, which is greater than 30 (e.g., a grayscale value of the background image 12). In this case, until the input grayscale value reaches 50, the image conversion unit 114 may gradually increase the background grayscale value which will be subtracted from the input grayscale value from the minimum value.

Referring to FIG. 9, when the input grayscale value exceeds a reference value (e.g., 50), the image conversion unit 114 may control a background grayscale value to be different from the background grayscale value when the input grayscale value does not exceed 50.

The image conversion unit 114 may execute image conversion processing on the display image 11 such that the input grayscale value corresponding to the display image 11 and the output grayscale value corresponding to the correction image 15 have a relationship as shown in FIG. 9. Thus, the black defect may be prevented in a dark portion of the corrected display image 15 according to an exemplary embodiment described with reference to FIG. 9.

Referring to FIGS. 7 and 8, to prevent the black defect when an input grayscale value increases from a minimum value to a grayscale value (e.g., 30) of the background image 12, the background grayscale value which will be subtracted from the input grayscale value is gradually changed. Referring to FIG. 9, when an input grayscale value increases from a minimum value to a reference value (e.g., a half of the maximum input grayscale value), regardless of the grayscale value of the background image 12, the background grayscale value is gradually increased, the black defect may be prevented when an input grayscale value is less than the reference value.

Figure 10:
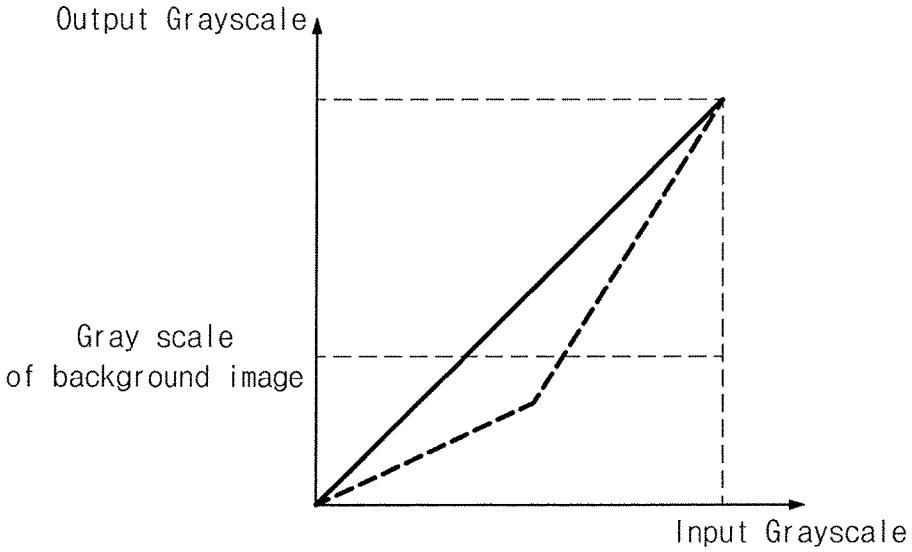
FIG. 10 is a graph illustrating image conversion processing performed by an image conversion unit according to an embodiment of the present inventive concept.

FIG. 10 is a graph illustrating image conversion processing performed by an image conversion unit 114 (e.g., in operation S102) according to an exemplary embodiment of the present inventive concept.

A solid line in the graph shown in FIG. 10 represents a relationship between an input grayscale value (e.g., a grayscale value of the display image 11 input to the image conversion unit 114) and an output grayscale value (e.g., a grayscale value of an image output from the image conversion unit 114) when no image conversion processing is performed. A broken line represents a relationship between an input grayscale and an output grayscale value (e.g., a grayscale value corresponding to the correction image 14 output from the image conversion unit 114) when the image conversion processing is performed. The image conversion processing may include subtracting the background grayscale value from the input grayscale value.

Referring to FIG. 10, the image conversion unit 114 may output an output grayscale value more than 0 when the input grayscale value is lower than a reference value.

For example, referring back to FIG. 6, the image conversion unit 114 outputs an output grayscale value of 0 until an input grayscale value reaches 30. Referring to FIG. 10, the image conversion unit 114 outputs an output grayscale value greater than 0 until the input grayscale value reaches a reference value, e.g., 50, which is greater than 30. In this case, until the grayscale value of the input grayscale reaches 50, the image conversion unit 114 may gradually increase the background grayscale value from the minimum value.

Referring to FIG. 10, when input grayscale value exceeds a reference value (e.g., 50), the image conversion unit 114 may perform image conversion processing on the display image 11 such that the maximum value of an input grayscale and the maximum value of an output grayscale are the same as each other when the input grayscale value reaches the maximum value. Hereinafter, a section where the input grayscale value is greater than 30 (e.g., a grayscale value of the background image 12) and less than 50 is referred to as a third section, and a section where the input grayscale value exceeds 50 is referred to as a fourth section. In this case, an output grayscale value corresponding to the grayscale value of the correction image 14 may be increased more greatly in the fourth section than in the third section. For example, the background grayscale value may gradually be decreased in the fourth section as a function of input grayscale value.

Referring to FIG. 10, the image conversion unit 114 may execute image conversion processing on the display image 11 such that the input grayscale value corresponding to the display image 11 and an output grayscale corresponding to the correction image 14 have a relationship as shown in FIG. 10. Thus, the black defect may be prevented in a dark portion of the corrected display image 15 according to an exemplary embodiment described with reference to FIG. 10.

Referring to FIGS. 7 and 8, to prevent the black defect when an input grayscale value increases from a minimum value to a grayscale value (e.g., 30) of the background image 12, the background grayscale value is gradually changed as a function of input grayscale value.

Referring to FIG. 10, when an input grayscale value is less than a reference value (e.g., a half of the maximum input grayscale value), regardless of the grayscale value of the background image 12, the background grayscale value that will be subtracted from the input grayscale value is gradually increased. In addition, when the input grayscale value exceeds the reference value, the background grayscale value is gradually decreased. Thus, according to an exemplary embodiment described with reference to FIG. 9, when an input grayscale value is less than the reference value, the black defect may be prevented, and when an input grayscale value is greater than the reference value, a range of the output grayscale value might not be narrow and thus, a range of the corrected display image 15 may become broader.

Referring to FIGS. 6 to 10, an output grayscale value is monotonously increased from a low grayscale toward a high grayscale as a function of input grayscale. In addition, although FIGS. 6 to 10 illustrate that an output grayscale value is linearly changed as a function of input grayscale value. However, the present inventive concept is not limited thereto, and the output grayscale value may be changed in a curved manner as a function of input grayscale value.

In addition, information for adjusting a grayscale value according each of the above-mentioned graphs of FIGS. 6 to 10 may be maintained in a format such as a lookup table inside the display control unit 100 of FIG. 2. Then, certain settings (e.g., information) maintained inside the display control unit 100 may be automatically selected by a user of the image display device 10 of FIG. 2, or a setting (e.g., information) maintained inside the display control unit 100 may be customized by a user of the image display device 10.

Thus, when the information for adjusting a grayscale value is maintained inside or customized by a user, the image display device 10 may display an image, depending on user's preference or environment, on the transparent display panel 200. For example, the display control unit 100 may automatically select an appropriate pattern according to a state (e.g., brightness or grayscale value) of the background image 12 that the optical measurement device 120 measures.

For example, if the background image 12 is darker than a predetermined value, the display control unit 100 may perform image conversion processing to prevent the grayscale value of the display image 11 from being dropped, and if the background image 12 is brighter than a predetermined value, the display control unit 100 may perform image conversion processing to drop the grayscale value of the display image 11.

As described above, according to an embodiment of the present inventive concept, provided is the image display device 10 including the display control unit 100. The display control unit 100 may display an image on the transparent display panel 200 on the basis of an image signal obtained by lowering the grayscale value of an input image (e.g., the display image 11) when the input image has a grayscale value less than a predetermined grayscale value.

On the basis of brightness of a transmittance light (e.g., the background image 12) that penetrating the transparent display panel 200, the display control unit 100 in the image display device 10 according to an embodiment of the present inventive concept may perform image conversion processing for lowering a grayscale value of an input image (e.g., the display image 11) to generate an output grayscale value corresponding a grayscale value of the corrected display image 15. Here, the output grayscale value may be kept unchanged or increased as the grayscale value of the input image (e.g., the display image 11) is increased. As described above, when the grayscale value of the input image (e.g., the display image 11) is less than a predetermined threshold value, the display control unit 100 may change the output grayscale value to the minimum value or lower the output grayscale value to a value than the grayscale value of the input image by multiplying a predetermined coefficient to the grayscale value of the input image.

Accordingly, the display control unit 100 included in the image display device 10 according to an embodiment of the present inventive concept suppresses the influence due to an background image 12 on the display image 11 to be displayed on the transparent display panel 200 by lowering a grayscale value of the display image 11 when the display image 11 has a grayscale value less than a predetermined grayscale value. Thus an originally intended display image 11 may be displayed to a user.

An image display device 10 according to an embodiment of the present inventive concept may have increased visibility without raising manufacturing cost.

In this specification, a computer program for executing features or operations of each of the above-mentioned devices (e.g., the display control unit 100 and the transparent display panel 200) may be written in hardware such as central processing unit (CPU), read only memory (ROM), and random access memory (RAM). Each of the CPU, the ROM, the RAM may be embedded in one of the above-mentioned devices. In addition, a storage medium for storing the computer program may be provided. In addition, each functional block of a block diagram (e.g., see FIG. 3) may be configured with a hardware, and thus, a series of processes may be realized in a hardware.

While exemplary embodiments of the present inventive concept have been particularly shown and described, it will be understood that various change in form and detail may be made therein without departing from the spirit and scope of the present inventive concept as defined by the following claims.

What is claimed is:

1. An image processing device comprising:

an optical measurement device configured to measure light of a background image seen by a user through an at least partially transparent display panel and to generate a signal therefrom; and a display control circuit configured to output a correction image to the transparent display panel to display the correction image through the transparent display panel, wherein the display control circuit comprises:

a light detection circuit connected to the optical measurement device, configured to receive the signal, and configured to detect a first grayscale value therefrom; and an image conversion circuit connected to the light detection circuit and configured to generate the correction image having a second grayscale value obtained by subtracting a third grayscale value pertaining to the first grayscale value from a fourth grayscale value of an input image inputted to the transparent display panel.

2. The device of claim 1, wherein the transparent display panel comprises an organic light emitting device.

3. The device of claim 1, wherein the image conversion circuit adjusts the second grayscale value to a minimum value when the fourth grayscale value is smaller than the first grayscale value.

4. The device of claim 1, wherein the image conversion circuit increases the third grayscale value when the fourth grayscale value increases from a minimum value to the first grayscale value.

5. The device of claim 4, wherein the image conversion circuit decreases the third grayscale value when the fourth grayscale value increases from the first grayscale value toward a maximum value.

6. The device of claim 1, wherein the image conversion circuit increases the third grayscale value when the fourth grayscale value increases from a minimum value to a fifth grayscale value higher than the first grayscale value.

7. The device of claim 6, wherein the image conversion circuit decreases the third grayscale value when the fourth grayscale value increases from the fifth grayscale value toward a maximum value.

8. An image processing method comprising:

measuring a value of light of a background image using an optical measurement device, wherein the background image is an image seen by a user through an at least partially transparent display panel, and generating a signal therefrom;

detecting a first grayscale value from the signal generated by the optical measurement device using a light detection circuit;

generating a correction image having a second grayscale value obtained by subtracting a third grayscale value pertaining to the first grayscale value from a fourth grayscale value of an input image inputted to the at least partially transparent display panel, using an image conversion circuit; and displaying the correction image on the at least partially transparent display panel.

9. A display device comprising:

an at least partially transparent display panel for displaying an input image;

a light detection unit configured to detect a first grayscale value of a background image, wherein the background image is an image disposed behind and through the at least partially transparent display panel; and an image conversion unit configured to generate a correction image having a second grayscale value obtained by subtracting a third grayscale value pertaining to the first grayscale value from a fourth grayscale value of the input image inputted to the at least partially transparent display panel, and to output the generated correction image to the at least partially transparent display panel, wherein the input image is an image intended to be displayed on the at least partially transparent display panel.

10. The device of claim 9, wherein the at least partially transparent display panel comprises an organic light emitting device.

11. A display device comprising:

an at least partially transparent display panel for displaying an intended image; and a display control unit for generating a correction image to the at least transparent display panel, wherein the display control unit comprises:

an optical measurement device for measuring information corresponding to a background image, wherein the background image is an image seen by a user through the at least partially transparent display panel;

a light detection unit for obtaining a first grayscale value based on the information output from the optical measurement device; and an image conversion unit configured to generate the correction image having a second grayscale value obtained by subtracting a third grayscale value pertaining to the first grayscale value from a fourth grayscale value of the intended image, wherein the second grayscale changes in a first slope with respect to the fourth grayscale value when the fourth grayscale value is less than a reference value, wherein the second grayscale changes in a second slope with respect to the fourth grayscale value when the fourth grayscale value is greater than the reference value, and wherein the second slope is higher than the first slope.

12. The display device of claim 11, wherein the at least partially transparent display panel includes an organic light emitting device.

13. The display device of claim 11, wherein the first slope is zero when the fourth grayscale value is less than the reference value.

14. The display device of claim 11, wherein the reference value is equal to or greater than the first grayscale value.

15. The display device of claim 11, a maximum value of the second grayscale value and a maximum value of the fourth grayscale value are the same as each other.

* * * * *